United States Patent [19]

Nurney

[11] Patent Number: 4,515,142

[45] Date of Patent: May 7, 1985

[54] COMPOUND BOW AND ECCENTRIC WHEEL ASSEMBLIES THEREFOR

[75] Inventor: David J. Nurney, Seattle, Wash.

[73] Assignee: Indian Industries, Inc., Evansville, Ind.

[21] Appl. No.: 462,385

[22] Filed: Jan. 31, 1983

[51] Int. Cl.[3] ..... F41B 5/00

[52] U.S. Cl. ..... 124/23 R; 124/DIG. 1

[58] Field of Search ..... 124/23 R, 24 R, 90, 124/86, 80

[56] References Cited

U.S. PATENT DOCUMENTS

| | | | |
|---|---|---|---|
| 3,486,495 | 12/1969 | Allen . | |
| 3,841,295 | 10/1974 | Hunter . | |
| 3,851,638 | 12/1974 | Alexander | 124/90 X |
| 3,854,467 | 12/1974 | Hofmeister . | |
| 3,945,368 | 3/1976 | Jones . | |
| 3,958,551 | 5/1976 | Ketchum . | |
| 4,005,696 | 2/1977 | Jennings . | |
| 4,054,118 | 10/1977 | McKee et al. . | |
| 4,060,066 | 11/1977 | Kudlacek | 124/23 R |
| 4,064,862 | 12/1977 | Groner . | |
| 4,078,538 | 3/1978 | Shepley . | |
| 4,241,715 | 12/1980 | Jennings . | |
| 4,261,320 | 4/1981 | Barna . | |
| 4,365,611 | 12/1982 | Nishioka | 124/24 R |

OTHER PUBLICATIONS

Bear Archery, 1983, pp. 4 and 5, cited by applicant.

*Primary Examiner*—Richard J. Apley
*Assistant Examiner*—William R. Browne
*Attorney, Agent, or Firm*—Woodard, Weikart, Emhardt & Naughton

[57] ABSTRACT

A compound bow includes a handle portion and appended limbs, eccentric wheel assemblies mounted to each bow limb, and a cable attached at its ends to the bow limbs and extending over the wheel assemblies. Each wheel assembly includes a bowstring wheel having a peripheral groove, a first take-up wheel having a peripheral groove, and a central passageway communicating between the grooves to permit attachment of the bow cable. A second take-up wheel is secured to the bowstring wheel and includes a peripheral groove which is aligned with the groove of the first take-up wheel. The take-up wheels are configured such that the cable is not received in the groove of the second take-up wheel when the bow is in the relaxed condition, but is so received when the bowstring is drawn. The draw characteristics of the bow are therefore changeable by substituting various shapes of the second take-up wheel, and such substitution may be readily accomplished without requiring that the bow be dismantled or unstrung.

11 Claims, 7 Drawing Figures

COMPOUND BOW AND ECCENTRIC WHEEL ASSEMBLIES THEREFOR

BACKGROUND OF THE INVENTION

1. Field of the Invention

The present invention relates to the field of compound bows including eccentrically mounted pulleys or wheels at the ends of the bow limbs, and more particularly to a modular wheel assembly for use with compound bows to permit varying of the draw weight and/or draw length of the bow.

2. Description of the Prior Art

Compound bows, as is well known in the art, utilize eccentrically positioned string or cable mounting pulleys secured to the free ends of the bow limbs. The pulleys provide a mechanical advantage to increase the amount of potential energy stored in the limbs as the arrow string is drawn. With this arrangement, when the arrow string is in the full draw position a maximum potential energy is stored in the bow while the force required to maintain the arrow in the full draw position is less than the maximum draw weight of the bow. As the arrow string portion is being drawn, the draw weight or string drawing force applied to the bow increases to a maximum draw weight and lets off to a lower draw weight at the full draw position. This has been found to substantially improve the performance of the bow and the ease of operation of the bow.

The physics of archery bow action is disclosed in my prior, co-pending patent application entitled "High Energy Limb Tip Cam Pulley Archery bow," filed Oct. 30, 1982, U.S. Ser. No. 438,204; which application is hereby incorporated by reference for this description of the physics of the bow action. This co-pending application is also incorporated by reference for other descriptions which it provides, as will be referenced hereinafter.

Perhaps the first description of the principles of the compound bow system is contained in U.S. Pat. No. 3,486,495, issued to Allen on Dec. 30, 1969. This patent discloses a fairly simple compound bow design in which a pair of one-piece, oblong pulley wheels are mounted at the opposite ends of the bow. As the arrow string is drawn back, the pulley wheels rotate and the draw weight first increases to a maximum and then decreases. Various other compound bow arrangements utilizing similar eccentric pulleys are described in U.S. Pat. Nos. 3,841,295; 3,854,467; 3,945,368; 3,948,551; 4,005,696; 4,054,118; 4,064,862; and 4,078,538.

The eccentric pulleys used with prior art units have generally been provided for using a single cable or string position on the bow. This single position is generally fixed and does not allow for cable adjustments. If it is desired to change the draw weight or the draw length of the compound bow, this is normally accomplished either by substituting different eccentric pulleys, or by physically changing the cable length, or by providing for adjustment between the limbs and the handle.

The draw length or the length at which the arrow string is pulled to impart potential energy in the limbs of the bow is one of the principal variables of the compound bow, and is determined by the physical requirements of the archer. For example, an archer of shorter height might prefer a draw length of 26 inches as compared to a taller archer who might prefer a draw length of 30 inches. However, in both cases the same percentage drop-off in draw weight may be desired between the maximum draw weight during the drawing cycle and the draw weight in the full draw position.

In order to effect a change in the draw length but maintain the same percentage drop-off it has been required in past devices to utilize pulleys having different diameters so as to provide a change in the length of the cable reeved about the pulley. By controlling the diameter size of the pulleys it has been possible to provide variations in the draw weight and draw length of the bow. Thus it has been the practice with conventional bows to change pulleys on the limbs to provide a preselected pulley diameter for a preselected draw length, requiring that a number of sets of pulleys of different diameters be made available for each bow. This practice substantially reduces the flexibility of a compound bow, for example in use as both a hunting and a competitive bow or for use by more than one archer of varying physical characteristics or requirements.

Another approach for enabling the draw length and/or draw weight to be adjusted has been to vary the path of the cable around or through the eccentric pulleys. In U.S. Pat. No. 4,241,715, issued to Jennings on Dec. 30, 1980, there is described a compound bow having eccentrics with various cable paths. In order to change the draw weight or length characteristics, the cable is threaded through the eccentrics along varying paths. A similar approach is described in U.S. Pat. No. 4,261,320, issued to Barna on Apr. 14, 1981. An adjustable compound bow is described in U.S. Pat. No. 3,958,551, issued to Ketchum on May 25, 1976, in which the eccentric pulley is provided in two halves, one associated with the take-up portion of the cable and the other with the bowstring portion. To vary the bow characteristics, different sized halves are combined to form an eccentric which is then mounted to the bow and threaded with the cable. In U.S. Pat. No. 4,061,124, issued to Groner, a limited adjustment in the draw length of the arrow string for the disclosed bow is accomplished by kinking portions of the cable to thereby limit the amount of cable that can be unwound from the pulley when the arrow string is drawn.

Another disclosure which may be relevant to the present invention is the design of the Bear Delta-V bow offered by Bear Archery of Gainesville, Fla. and as detailed in their 1983 Catalog "Bear Archery '83" on pages 4 and 5. The Delta-V bow incorporates conventional pulleys at the tips of the bow limbs and in this regard is significantly different than many of the other prior art references. Extending inwardly from the grip toward the bowstring are two, oppositely disposed draw length blocks incorporating special cam designs. However, in order to interface these cam designs with the remainder of the bow, a variety of added components are necessary thereby increasing cost and complexity. By using conventional pulleys at the tips, a number of stringing revisions are necessary. The interior/central location of the draw length blocks and cams is believed to be a disadvantage, note the need for power bumpers to avoid bowstring interference. Of possible interest with respect to the present invention is the removable cam portion (red part in catalog).

Although various methods and designs have been proposed in the prior art for adjusting draw length and weight, they have included at least two deficiencies. First, it has not typically been possible to independently adjust the draw length and the draw weight with such devices. Changes in diameter for the take-up track of the eccentrics produces a change in both the draw length and the draw weight. Second, all of the prior art units require that the compound bow be disassembled to some extent in order to permit the replacement of the eccentric wheels or portions thereof. Those in the art will recognize that it is preferable to enable adjustments of the draw length and draw weight without the need to unstring the bow, since this is a time-consuming and difficult procedure. For most, the requirement that the bow be unstrung means that the bow must be brought to a professional shop which has the equipment, such as a bow press, and the expertise to accomplish this task. Further, this restricts the speed and ease for making such changes and therefore limits the usefulness of the ability to adjust the bow characteristics.

SUMMARY OF THE INVENTION

Briefly describing one aspect of the present invention there is provided a compound bow including a handle portion and appended limbs, eccentric wheel assemblies attached to the limbs, and a cable extending over the wheel assemblies and connected with the bow. The wheel assemblies include a bowstring wheel defining a peripheral groove, a first take-up wheel component secured to the bowstring wheel and defining a second peripheral groove, and a passageway communicating with the first and second grooves and extending through the central portions of the bowstring wheel and take-up wheel component. The wheel assemblies also include a second take-up wheel component attachable to either the bowstring wheel or the first take-up wheel. The second take-up wheel defines a peripheral groove within which the bowstring is received when the bow is drawn, but not when the bow is in the relaxed condition. The second take-up wheel component is provided in a variety of shapes to give the bow different draw characteristics depending on which component is installed.

It is an object of the present invention to provide an improved compound bow which has adjustable characteristics of draw length and draw weight.

Another object of the present invention is to provide a compound bow in which the draw weight and draw length can be independently varied.

It is a further object of the present invention to provide a compound bow which permits for the adjustment of draw weight and draw length without the need to unstring or otherwise disassemble the bow.

Another object of the present invention is to provide an eccentric wheel assembly which is adapted for use in conjunction with a compound bow to permit the draw weight and draw length of the bow to be adjusted independently of one another, and without the need to disassemble or restring the bow.

It is a further object of the present invention to provide a compound bow, and particularly an eccentric wheel assembly therefor, which permits the draw weight and draw length to be varied in a simple, quick fashion which does not require special expertise or expensive equipment.

Further objects and advantages of the present invention will become apparent from the description of the preferred embodiment which follows.

DESCRIPTION OF THE PREFERRED EMBODIMENT

Figure 1:
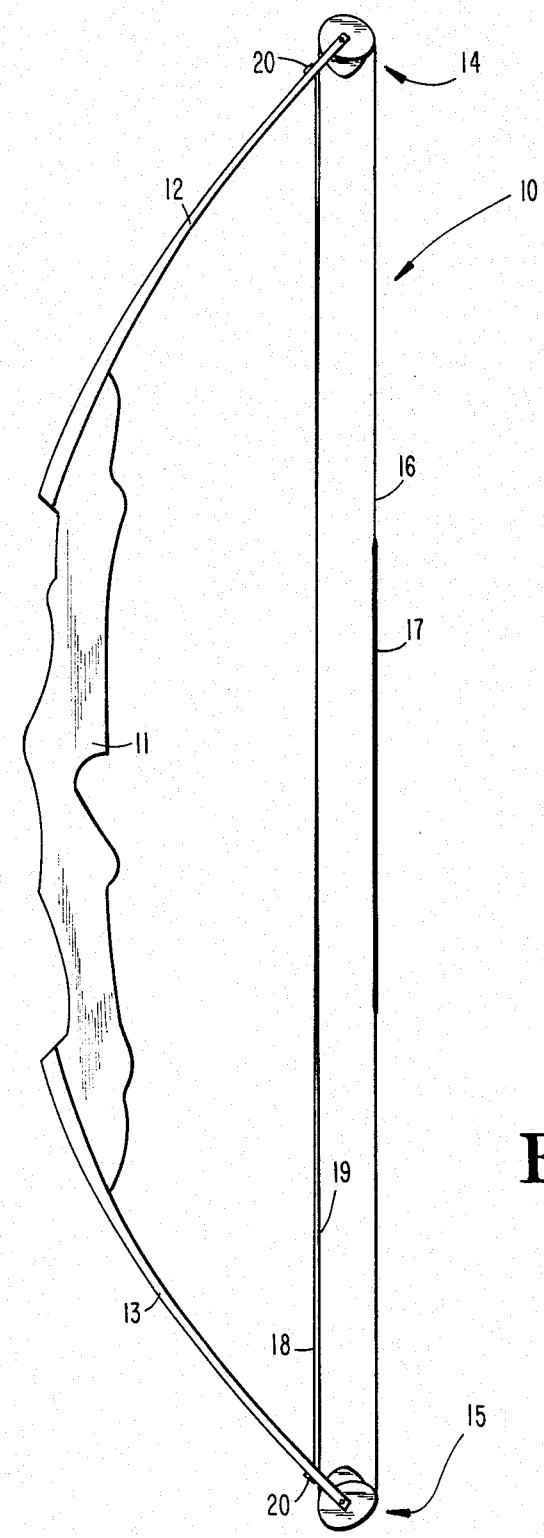
FIG. 1 is a plan view of a compound bow constructed in accordance with the present invention, and particularly including adjustable eccentric wheel assemblies as provided herein.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there is shown in FIG. 1 a compound bow 10 constructed in accordance with the present invention. In standard fashion, the bow 10 includes a center handle portion 11 for gripping the bow, and a pair of limbs 12 and 13 which extend outwardly from opposite ends of the handle. A pair of eccentric wheel assemblies 14 and 15 are secured to the free outer end portions of the limbs. A continuous cable 16 is mounted to the bow. The cable includes a central, bowstring portion 17 and end portions 18 and 19 which extend over the wheel assemblies. The end portions of the cable are connected to the bow limbs in any of a variety of fashions, such as by extending through apertures (not shown) in the bow limbs and being secured to connectors, such as 20, on the outside of the limbs.

It will be apparent to those in the art that the compound bow operates in usual fashion by using the eccentrically mounted wheels to provide a mechanical advantage for drawing back the bowstring portion of the cable. The general operation and principles associated with compound bows have been described in the literature, including the patent references cited previously. Further detailing of the basic design concept of a compound bow is therefore not provided herein.

Figure 2:
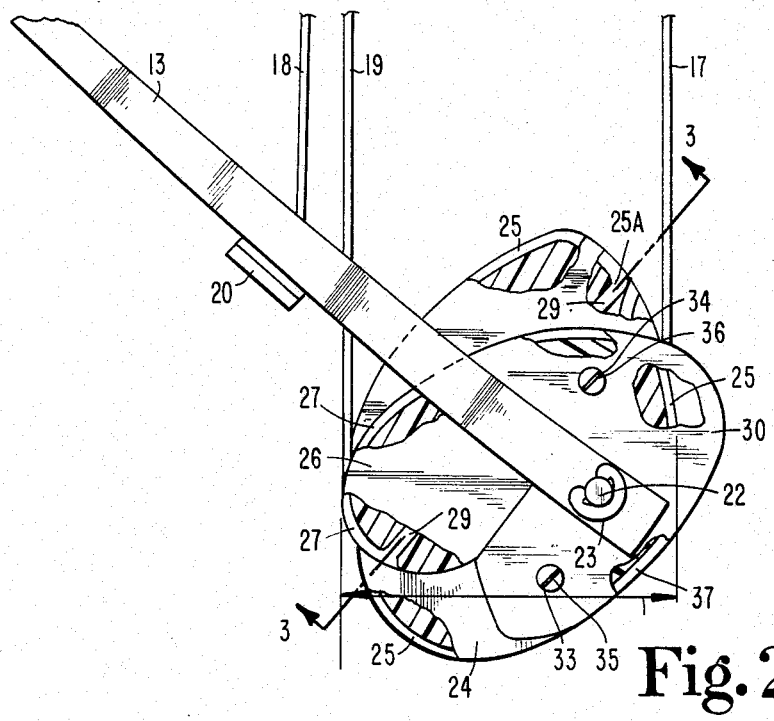
FIG. 2 is a fragmentary plan view of a portion of the compound bow of FIG. 1 showing the mounting of the eccentric wheel assembly to the bow limb.

My prior, co-pending application, U.S. Ser. No. 438,204 discloses a novel cam (pulley) action concept as part of the eccentric wheels wherein the characteristics of the draw force vs. draw length curve are changeable by changing the geometry of the cam wheels (pulleys) which are employed. As is fully disclosed in this co-pending application, which is hereby incorporated by reference for this cam wheel (pulley) description, the ratio of the bowstring lever arm (B) to the take up string lever arm (T) (see FIG. 2) allows one to selectively vary the draw force—draw length curve. As will be appreciated from my co-pending application, the geometry of the cam wheel controls this ratio as well as the changes to this ratio as the bowstring is drawn and the cam wheel rotates.

While incorporation by reference of my co-pending application is not necessary to a full and complete appreciation the present invention, it is felt that an appreciation of my prior application will contribute to one's overall understanding of the bow action and the physics of the cam-type pulleys.

To an extent, the characteristics of a compound bow are determined by the size and shape of the eccentric wheels and other portions of the apparatus. It has been necessary in the past to materially alter the bow, usually by adjustments of the handle and limbs or by replacement of the eccentric wheels, in order to vary the bow properties. The present invention overcomes this disadvantage of earlier units by enabling the characteristics of the bow to be altered simply by modifying a portion of the eccentric wheels, without needing to dismantle the bow itself.

Figure 4:
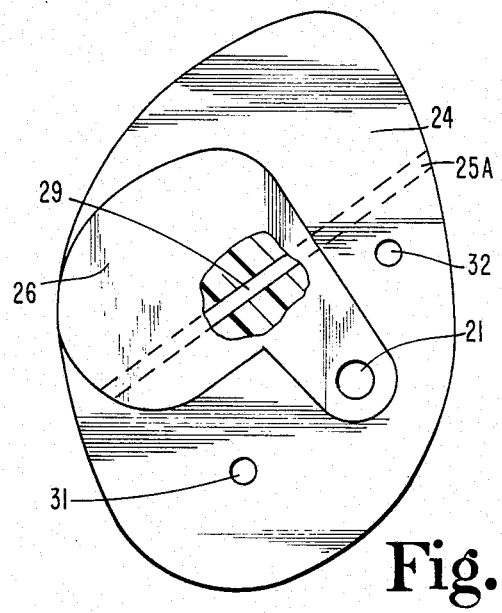
FIG. 4 is a plan view of a preferred embodiment of the bowstring wheel and first, take-up wheel component according to the present invention.

The present invention provides an eccentric wheel assembly which permits the ready adjustment of the characteristics of a compound bow. The wheel assemblies are rotatably attached to the limbs in standard fashion. For example, the assemblies define an aperture 21 (FIG. 4) aligned with corresponding apertures in the bow limb. A pin 22 is received through the apertures and is held in place by means of a snap ring 23. As is apparent from FIG. 2, the wheel assemblies are thereby mounted eccentrically to rotate about the axis of the pin 22.

Each wheel assembly, such as 15 (FIG. 2), includes a bowstring wheel 24 which has a central portion and a periphery. The bowstring wheel 24 defines a first, cable-receiving groove 25 about at least a portion of its periphery. The bowstring wheel 24 of the present invention is substantially wrapped by the cable 16 when the bow is in the relaxed condition as shown in FIG. 1. For example, in FIG. 1 the cable 16 extends around the bowstring wheel from the bowstring portion 17 to the location 26, at which point the cable extends into the central portion of the wheel. The cable-receiving groove is therefore provided at least along that portion of the wheel periphery which receives the cable.

Each wheel assembly also includes a first take-up wheel component 26 mounted to the bowstring wheel. This first take-up wheel is preferably formed integral with the bowstring wheel, but may also be attached by various means such as by screws or bolts.

Figure 3:
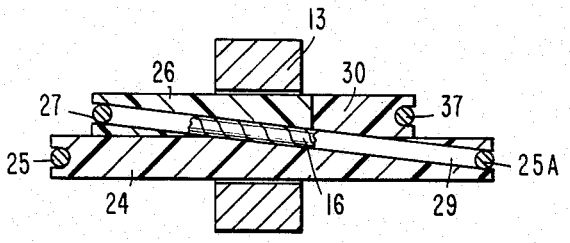
FIG. 3 is a cross-sectional view of the eccentric wheel assembly shown in FIG. 2, taken along line 3—3 and looking in the direction of the arrows.

The first take-up wheel 26 has a central portion and a periphery, and defines a second, cable-receiving groove 27 about at least a portion of its periphery. In the relaxed condition of the bow, the cable typically is received about only a limited portion of the periphery of the take-up wheel. As shown for example in FIG. 2, the cable portion 19 extends within groove 27 only to the location 28, at which point the cable extends into the central portion of the wheel. A passageway 29 (FIG. 3) extends within and is defined by the central portions of the bowstring wheel 24 and first take-up wheel component 26, and communicates with the peripheral grooves 25 and 27. A single cable 16 may therefore be threaded consecutively along groove 25, through the passageway 29 and along groove 27.

Figure 5:
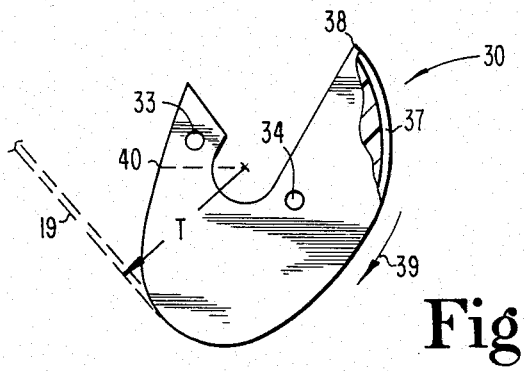
FIGS. 5–7 are plan views of exemplary, alternative shapes for the second, take-up wheel component useful with the present invention to vary the characteristics of a compound bow.

The eccentric wheel assembly also comprises a second take-up wheel component 30 which is mountable to the bowstring wheel and/or the first take-up wheel component. It will be appreciated that mounting to either will be sufficient since the bowstring wheel and first take-up wheel are secured to each other. Since the bowstring wheel is larger, it is more convenient and therefore preferable to mount the second take-up wheel component directly to the bowstring wheel. This may be accomplished, for example, by providing the bowstring wheel with a pair of apertures 31 and 32 (FIG. 4) and the second take-up wheel with a corresponding pair of apertures 33 and 34 (FIG. 5). Bolts 35 and 36 are received through the aligned apertures of the bowstring wheel and the second take-up wheel, and retained by nuts (not shown) in standard fashion.

The second take-up wheel component also includes a periphery and defines a third cable-receiving groove 37 about at least a portion of its periphery. As is apparent from FIG. 1, the first and second take-up wheel components are designed such that the cable is not received within the groove 37 when the bow is in the relaxed condition. More particularly, the cable does not extend adjacent any portion of the second take-up wheel when the bow is in the relaxed condition. As a result, the second take-up wheel can be readily removed, and replaced, when the bow is in the relaxed condition.

However, the cable is received within the groove 37 as the bowstring is drawn back. Consequently, the pull characteristics of the bow, such as the draw length and/or the draw weight, can be altered by substituting second take-up wheels of various shapes. For example, the timing of the let-off or the amount of the pull weight can each be independently controlled by varying the shape of the second take-up wheel over which the cable is received as the bowstring is drawn back.

Figure 6:
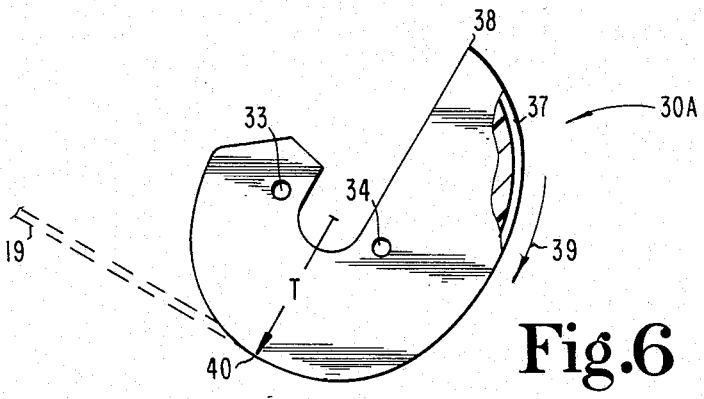
Figure 7:
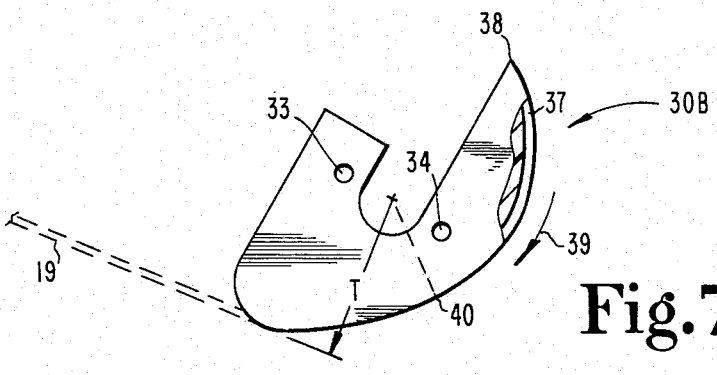

In FIGS. 5–7 there are shown three examples (30, 30A, 30B) of the variety of second take-up wheel components useful with the present invention. In each instance the shape of the wheel periphery, and therefore of the groove 37, has been modified to provide different draw characteristics for the bow. As the bowstring is drawn back, the cable will wrap around the second take-up wheel beginning at the location 38 and moving around the wheel in the direction which is denoted by arrow line 39. The different shapes of the take-up wheels, extending from the location 38, cause the take-up cable lever arm (T) to change as the take-up cable wraps around groove 37 as the bowstring is drawn. For example, the greater outward bulge for the wheels in FIGS. 5 and 6 in the initial portion of the take-up groove means that the "B" over "T" ratio will be lower in the initial stages of the draw, since "T" will be larger, and the draw force will rise more sharply in this region.

As a second example, the relationship of take-up cable 19, with respect to wheel 30 (30A, 30B) is shown for the same cam position and corresponding draw length in FIGS. 5–7, except that three alternative take-up wheel shapes are shown for comparison. In the design shown in FIG. 5, moment (lever) arm (T), while still decreasing is larger than the comparable moment arm (T) produced at the same point in the draw by the wheel shown in FIG. 6. Consequently, the draw force at this point in the draw sequence is higher for the FIG. 5 wheel design than in the FIG. 6 wheel design.

In the embodiment shown, the draw force at this point in the draw for FIG. 5 is still at or near the maximum value, while at the same point in the draw in the FIG. 6 alternative wheel design, the draw force is at its minimum or "full draw" value, since at this point in the FIG. 6 design, "T" is at its minimum value and as a result of the "B" to "T" ratio is at its maximum value. Continued rotation of wheel 30 (FIG. 5) initiates a reduction in draw force until a minimum value of "T" occurs. At the same point in the draw in the FIG. 7 design, the value of moment arm (T) has already passed its minimum point 40, so "T" is again increasing and the "B" to "T" ratio is reducing sharply with respect to further bowstring displacement and cam rotation. As a result, the draw force for the FIG. 7 design has already passed the normal full draw position and is rising sharply.

As should be understood, there is a direct relationship between the "B" over "T" ratio, a value which changes depending on the cam design and its position of rotation, and the draw force vs. draw length curve. As the foregoing description explains, as the "B" and "T" values vary during cam rotation, the applicable force vectors change as the draw length increases. My prior, co-pending application which has been incorporated by reference, provides a detailed description of the "B" over "T" ratio and the desirable characteristics of the draw force vs. draw length curve.

In much the same way that cam designs are derived by working from a curve of desired follower travel, so too can the design of the second take-up wheel be derived from a "B" over "T" curve relative to draw length. Consequently, once specific draw force and draw length characteristics are selected, the "B" over "T" curve can readily be derived, and from there the contour of the second take-up wheel determined.

It has been noted that there is a desire to be able to modify a compound bow to vary such properties as the draw weight and draw length. The present invention enables these modifications to be made independently of one another, and also simplifies the process. Changes may be made without resorting to a dismantling of the bow, which usually requires professional assistance and equipment. Further, the flexibility for a given compound bow is enhanced since a single archer may have various, preselected shapes of the second take-up wheel to adapt the bow for different hunting or competitive uses. Similarly, a single bow may be readily modified to adapt its use by different archers, particularly archers of different stature.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What I claim is:

1. A compound bow having adjustable eccentric wheel assemblies, said compound bow comprising:

a center handle portion for gripping the bow;

a pair of limbs extending outwardly from opposite ends of said handle portion, said limbs having inner end portions connected with said handle portion and also having free outer end portions;

cable means for flexing said pair of limbs;

eccentric wheel means for movably supporting said cable means on said limbs, said eccentric wheel means including an eccentric wheel assembly attached to the free outer end portion of each of said pair of limbs; and attachment means for rotatably attaching the eccentric wheel assemblies to said limbs;

each of the eccentric wheel assemblies including:

a bowstring wheel having a central portion and a periphery, the bowstring wheel defining a first, cable-receiving groove about at least a portion of its periphery;

a first take-up wheel component mounted to the bowstring wheel, the first take-up wheel component having a central portion and a periphery and defining a second, cable-receiving groove about at least a portion of its periphery;

the bowstring wheel and the first take-up wheel component also defining a passageway communicating with the first and second grooves and extending through the central portions of the bowstring wheel and the first take-up wheel component;

at least one second take-up wheel component removably mountable to one of the bowstring wheel and the first take-up wheel component, the second take-up wheel component including a periphery and defining a third cable-receiving groove about at least a portion of its periphery; and mounting means for removably mounting the at least one second take-up wheel component to the bowstring wheel and the first take-up wheel component to align the third cable-receiving groove with the second cable-receiving groove such that upon rotation of the first and second take-up wheel components a cable received within the second groove is also received within the third groove;

said cable means including a continuous cable having end portions secured to said pair of limbs and a central bowstring portion extending between the eccentric wheel assemblies, each of the end portions being associated with and extending over one of the pair of eccentric wheel assemblies, each of the end portions for the associated eccentric wheel assembly extending within the first, cable-receiving groove, through the passageway and within the second, cable-receiving groove, said compound bow having a first, relaxed condition in which the end portions are displaced from the third, cable-receiving groove of the associated eccentric wheel assembly, said compound bow also having a second, drawn condition in which the end portions are received within the third, cable-receiving groove of the associated eccentric wheel assembly.

2. The compound bow of claim 1 in which for each of the eccentric wheel assemblies the first take-up wheel component is formed integrally with the bowstring wheel.

3. The compound bow of claim 1 in which for each of the eccentric wheel assemblies the mounting means includes the bowstring wheel and the second take-up wheel component defining aligned apertures, the mounting means further including fastening members extending through the aligned apertures of the bowstring wheel and the second take-up wheel component for securing them together.

4. The compound bow of claim 3 in which for each of the eccentric wheel assemblies the first take-up wheel component is formed integrally with the bowstring wheel.

5. An eccentric wheel assembly useful in conjunction with a compound bow, said assembly comprising:

a bowstring wheel having a central portion and a periphery, said bowstring wheel defining a first, cable-receiving groove about at least a portion of its periphery;

a first take-up wheel component mounted to said bowstring wheel, said first take-up wheel component having a central portion and a periphery and defining a second, cable-receiving groove about at least a portion of its periphery;

said bowstring wheel and said first take-up wheel component also defining a passageway communicating with the first and second grooves and extending through the central portions of said bowstring wheel and said first take-up wheel component;

at least one second take-up wheel component removably mountable to said bowstring wheel and said first take-up wheel component, said at least one second take-up wheel component including a periphery and defining a third cable-receiving groove about at least a portion of its periphery: and mounting means for removably mounting said at least one second take-up wheel component to said bowstring wheel and said first take-up wheel component to align the third cable-receiving groove with the second cable-receiving groove such that upon rotation of said first and second take-up wheel components a cable received within the second groove is also received within the third groove.

6. The wheel assembly of claim 5 in which said first take-up wheel component is formed integrally with said bowstring wheel.

7. The wheel assembly of claim 5 in which said mounting means includes said bowstring wheel and said second take-up wheel component defining aligned apertures, said mounting means further including fastening members extending through the aligned apertures of said bowstring wheel and said second take-up wheel component and securing them together.

8. The wheel assembly of claim 7 in which said first take-up wheel component is formed integrally with said bowstring wheel.

9. An eccentric wheel assembly kit useful in conjunction with a compound bow, said assembly kit comprising:

a bowstring wheel having a central portion and a periphery, said bowstring wheel defining a first, cable-receiving groove about at least a portion of its periphery;

a first take-up wheel component mounted to said bowstring wheel, said first take-up wheel component having a central portion and a periphery and defining a second, cable-receiving groove about at least a portion of its periphery;

said bowstring wheel and said first take-up wheel component also defining a passageway communicating with the first and second grooves and extending through the central portions of said bowstring wheel and said first take-up wheel component;

a plurality of second take-up wheel components individually removably mountable to one of said bowstring wheel and said first take-up wheel component, each of said second take-up wheel components including a periphery and defining a third cable-receiving groove about at least a portion of its periphery, each of said second take-up wheel components having a different shape such that combination of each said second take-up wheel component with said bowstring wheel and said first take-up wheel will provide a different eccentric wheel assembly having different characteristics; and mounting means for removably mounting one of said second take-up wheel components to one of said bowstring wheel and said first take-up wheel component to align the third cable-receiving groove with the second cable-receiving groove such that upon rotation of said first and second take-up wheel components a cable received within the second groove is also received within the third groove.

10. The wheel assembly kit of claim 9 in which said mounting means includes said bowstring wheel and each of said second take-up wheel components defining aligned apertures, said mounting means further including fastening members extending through the aligned apertures of said bowstring wheel and one of said first take-up wheel components and securing them together.

11. The wheel assembly kit of claim 10 in which said first take-up wheel component is formed integrally with said bowstring wheel.

* * * * *